United States Patent [19]

Romstadt et al.

[11] Patent Number: 4,694,145

[45] Date of Patent: Sep. 15, 1987

[54] ELECTRONIC CONTROLLER FOR PREDETERMINED TEMPERATURE COEFFICIENT HEATER

[75] Inventors: Douglas J. Romstadt, Oregon, Ohio; William R. Seitz, Birmingham, Mich.

[73] Assignee: Allied Corporation, Morris Township, Morris County, N.J.

[21] Appl. No.: 701,907

[22] Filed: Feb. 15, 1985

[51] Int. Cl.[4] ..... H05B 1/02

[52] U.S. Cl. ..... 219/497; 219/205; 219/508; 219/505; 123/179 H

[58] Field of Search ..... 219/494, 205, 202, 203, 219/497, 499, 501, 483, 507, 508, 505; 123/179 H, 179 B

[56] References Cited

U.S. PATENT DOCUMENTS

| | | | |
|---|---|---|---|
| 3,789,190 | 1/1974 | Orosy et al. | 219/499 |
| 4,010,412 | 3/1977 | Forman | 219/492 |
| 4,245,148 | 1/1981 | Gisske et al. | 219/492 |
| 4,377,138 | 3/1983 | Mitani et al. | 219/497 |
| 4,478,181 | 10/1984 | Kikuchi et al. | 219/497 |
| 4,500,775 | 2/1985 | Sangu et al. | 219/497 |
| 4,511,792 | 4/1985 | Kawamura | 219/497 |

*Primary Examiner*—M. H. Paschall

*Attorney, Agent, or Firm*—Russel C. Wells; Markell Seitzman

[57] ABSTRACT

An electronic controller for a predetermined temperature coefficient heater provides solid state control of the application of power to the heater. In particular, a positive temperature coefficient glow plug wherein the heater is plated on a ceramic substrate glow plug is controlled by contactless solid state controller. The temperature of the glow plug is sampled by a clock signal and compared with a predetermined temperature value. Pulsed power is supplied to elevate and maintain the temperature of the heater to the predetermined value. In a complete motor vehicle engine wherein one glow plug is used in each cylinder, one glow plug is sampled and controls the remainder of the plugs.

2 Claims, 6 Drawing Figures

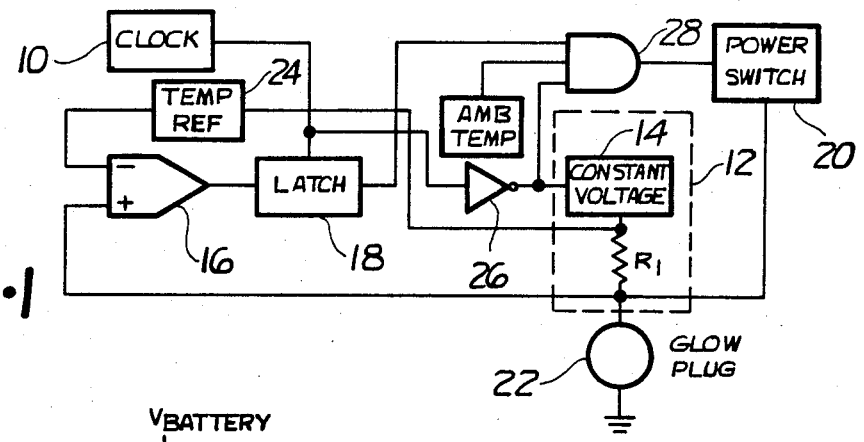
Fig·1
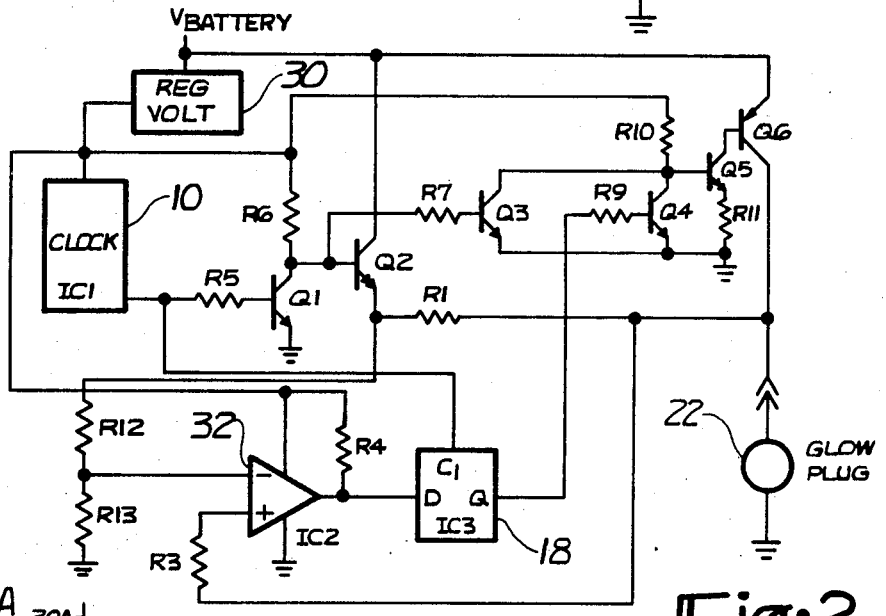
Fig·2
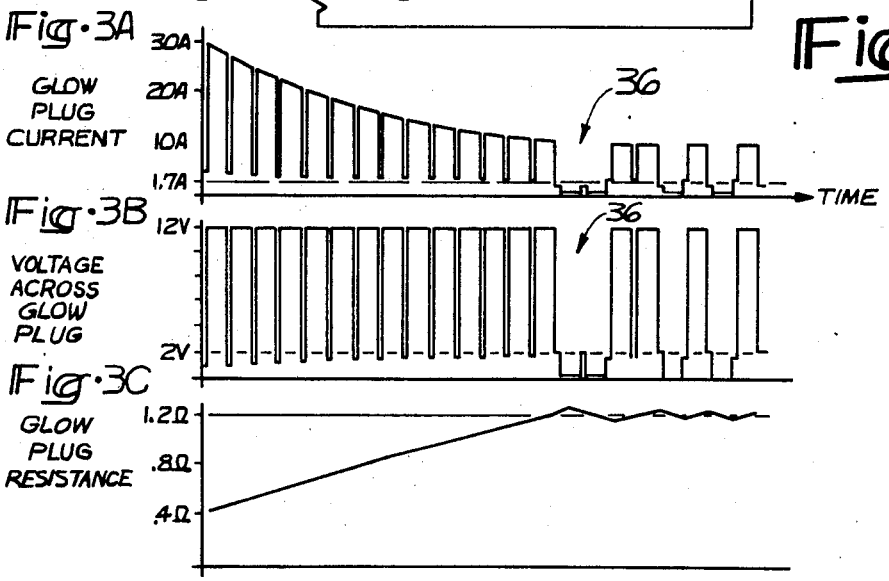

ELECTRONIC CONTROLLER FOR PREDETERMINED TEMPERATURE COEFFICIENT HEATER

This invention relates to controllers for predetermined temperature coefficient heaters in general, and more particularly to a solid-state contactless controller for wireless glow plugs for diesel engines.

CROSS-REFERENCE TO RELATED APPLICATIONS

U.S. Pat. No. 4,607,153, issued on Aug. 19, 1986, entitled "ADAPTIVE GLOW PLUG CONTROLLER" and filed by Leoncoi T. Ang on Feb. 15, 1985, and assigned to a common assignee."

BACKGROUND OF THE INVENTION

Compression ignition engines or diesel engines rely on the pressure and resultant temperature of the fuel in the cylinder in order to cause ignition to drive the engine. As is well known, in each cylinder it is necessary to provide a glow plug to raise the temperature of the fuel during cold starts and other conditions when the fuel and environmental temperatures are low. Glow plugs are typically wire wound devices having a very low resistance. These devices are electrically connected through a controller across vehicle batteries drawing heavy current loads. The reason for the low resistance is to generate a high temperature in a short response time.

Controllers for wire wound glow plugs contain one or more relays and one or more relay contacts in the circuit in order to open and close the power path to the glow plug. This opening and closing operates to regulate the amount of current flowing to the glow plug as well as turning the glow plug off when the temperature of the engine is sufficient for compression ignition.

Wire wound glow plugs are now being replaced with solid-state glow plugs wherein a predetermined temperature coefficient heating material, such as a positive temperature coefficient material is deposited on a ceramic base. This glow plug is then positioned in the cylinder in a manner similar to its wire wound predecessor. The resistance value of the heating material on the glow plug is generally higher than that of the wire wound on the glow plug, however, the heating time of the positive temperature coefficient material is much faster than the wire wound. In order to accurately control the heating of the solid state glow plugs, it is necessary to replace the relays and the several contacts with faster acting solid state components.

SUMMARY OF THE INVENTION

In order to solve the above-identified problem there is disclosed herein an electronic controller for heating a device having a predetermined temperature coefficient heating material deposited on a ceramic base. In particular, such a device may be a glow plug for a diesel engine or generally may be any type of electrical heating device. In the controller there is a means responsive to the flow of current through the heating material to generate an electrical signal proportional to the resistance of the material. Additioally, there is a means generating a signal representing a predetermined resistance value of the material. These two signals are brought together to generate a signal of one level when the electrical signal proportional to the resistance of the material indicates that its resistance is less than the predetermined resistance. In addition, another signal of another level is generated when the predetermined resistance is less than the resistance of the material.

The above-described controller can be used in an overall system for controlling positive temperature coefficient glow plugs for starting diesel engines by locating at least one glow plug in each cylinder of the diesel engine. A power supply is provided for supplying power to each of the glow plugs under the control of the controller. One of the glow plugs is sensed to generate a first electrical signal proportional to the temperature of the glow plug. Another means is provided for determining the operating temperature of the engine and to generate a second electrical signal proportional to the actual operating temperature. A fourth electrical signal is generated representing a predetermined operating temperature of the engine. The output of the electronic controller is then supplied to a means which is responsive to the two temperature signals for controlling the supplying of the power to the glow plugs when the actual temperature is less than the predetermined operating temperature.

It is, therefore, a principle advantage of the invention to provide a contactless controller for controlling predetermined temperature coefficient glow plugs.

It is another advantage of the system to provide a controller sensing one of a plurality of glow plugs and for controlling the operation of all the glow plugs in response thereto.

These and other advantages will become apparent from the following drawings and detailed description.

DESCRIPTION OF THE DRAWINGS

In the drawings:

FIG. 1 is a block diagram of one embodiment of an electronic glow plug controller.

FIG. 2 is a schematic of the embodiment of FIG. 1.

FIGS. 3A, 3B and 3C are graphic illustrations of the voltage and current at different points in FIG. 2.

DETAILED DESCRIPTION

Figure 4:
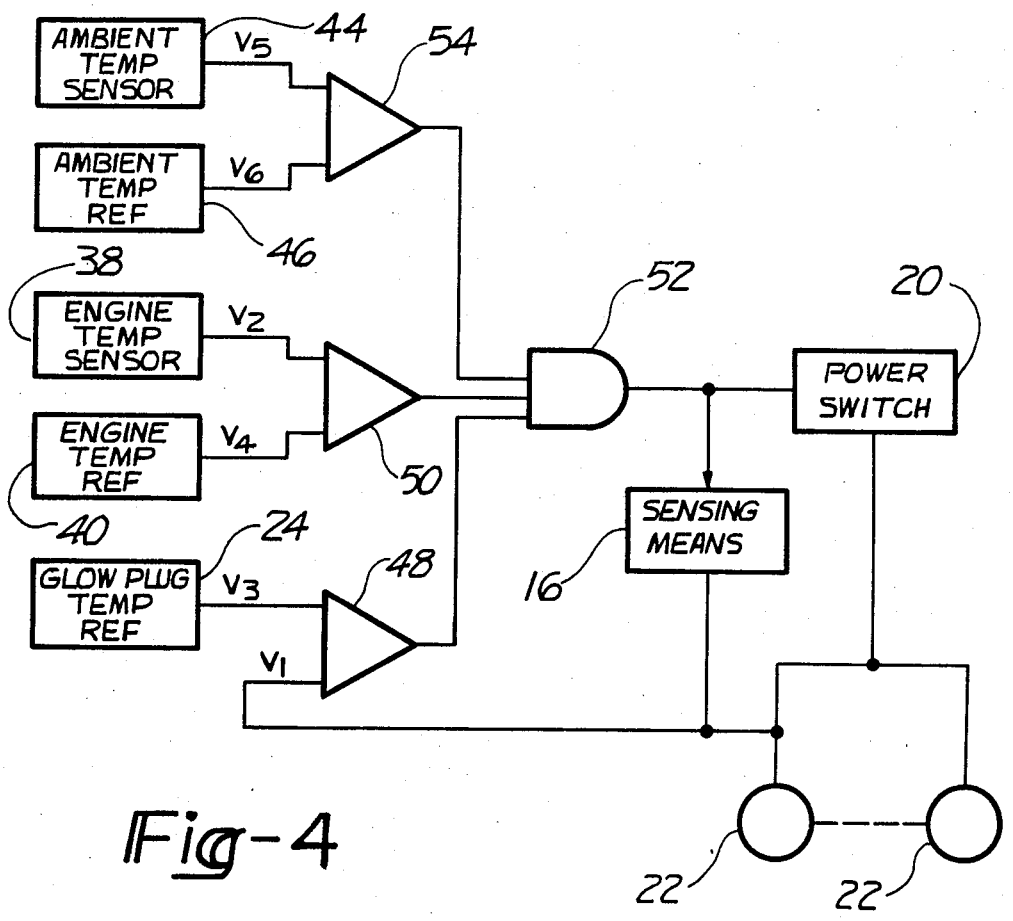
FIG. 4 is a block diagram of the system using the glow plug controller.

Fast-acting glow plugs of the type found in U.S. Pat. No. 4,545,339, issued Oct. 8, 1985, and entitled "Glow Plug Having a Conductive Film Heater" by Mark A. Brooks et al, provide a fast-acting temperature device to cause ignition in a diesel engine during times such as cold start. An improved version of the above-identified glow plug is found in U.S. patent application No. 507,254, filed on June 23, 1983 and entitled "An Improved Glow Plug Having a Resistive Surface Film Heater" by Mark A. Brooks et al. Both of the above are assigned to the same assignee as the present invention and incorporated herein by reference.

Referring to FIG. 1, there is illustrated in block form an electronic controller according to the present invention that is applicable for the above-identified glow plugs. FIG. 1 neither shows, illustrates, nor requires devices such as relays or contacts to control the power within the controller. It is well known that if this is used in an automobile or other motor vehicle, the power from the battery is switched power under control of an ignition key or similar device but in the system of FIG. 1, the power controlled by the controller is not switched through contacts. The controller may be described as a single channel controller inasmuch as it controls one glow plug. Since most diesel engines have more than one cylinder, the circuit of FIG. 1 may be duplicated an equal number of times as there are number of glow plugs in the engine. However, as will be shown hereinafter, sophistication in the form of time sharing or multiplexing of the above circuit will provide for controlling more than one glow plug. In addition, additional glow plugs can be electrically connected in parallel.

Referring to FIG. 1, there is illustrated a clock means 10, sensing means 12 including a constant voltage source means 14 and a sensing resistor R1, a comparison means 16, a latch means 18, power switch means 20, a glow plug 22 and a temperature reference means 24. The logic rules for this particular circuit require positive voltage levels for ON or activating conditions and use positive going signals to actuate.

The clock means as used in FIG. 1 generates a pulse train having a sample period and an activation period. In the preferred embodiment, the sample period is 200 microseconds and the overall clock period is seven milliseconds. This timing is a matter of design although the sample period should be as short as possible. In the present method of sensing, it was found that the sensing resistor or R1 sensor was stable within 200 microseconds after the application of sensing current. Therefore, this defined the sample period. Again, in the preferred embodiment the pulse train of clock signals comprises a negative going sample period for 200 microseconds after which time there is a positive going pulse which remains on for the remainder of the seven millisecond period.

The sensing means 12 as illustrated in FIG. 1 is responsive to the sample period signal from the clock 10 which through an inverter 26 is a positive going signal for turning on a constant voltage means 14. The constant voltage means 14 supplies a current equal to the voltage output of the constant voltage means 14 divided by the summation of the resistance of the glow plug 22 and the sensing resistor R1. By measuring the voltage drop across the glow plug 22 its resistance is determined. The temperature of the glow plug 22 is proportional to its resistance, thus the sensing means 12 in effect measures the temperature of the glow plug 22 and generates a temperature signal representing that temperature.

The comparison means 16 receives the temperature signal from the glow plug 22 and a predetermined temperature reference signal from the temperature reference means 24 and generates a comparison signal indicating the relationship of the predetermined temperature and the temperature of the glow plug 22. The predetermined temperature reference means 24 generates an electrical signal having a characteristic which is identical to the characteristic of the glow plug when it obtains its operating temperature. In the preferred embodiment as illustrated in FIG. 1, the temperature signal generated by the sensing means 12 and the predetermined temperature reference signal from the temperature reference means 24 are voltage signals and the output of the comparator 16 is the signal of one polarity when the glow plug 22 is not at its operating temperature and a signal of another polarity when the glow plug 22 is at its operating temperature.

The latch circuit means 18 is activated during the activation period from the clock means 10 and for storing the comparison signal to generate a power applying control signal. The output of the latch circuit means 18 is supplied to a logic means or logic gate 28 which functions to insure that the power switch means 20 is off during the sample period. When both signals to the logic gate 28 are positive or at one voltage level, the output of the gate 28 is sufficient to activate the power switch means 20. When the glow plug 22 is at temperature, the output of the comparator means 16 resets the latch circuit means 18, therefore, the latch signal and the clock signal being of opposite voltage levels, causes the output of the logic gate 28 to turn off the power switch means 20.

Referring to FIG. 2, the sensing means 12 comprises the circuit having transistor Q1 and Q2 which together are the constant voltage source means 12 supplying a constant voltage to the sensing resistor R1. As illustrated, the collector lead of the resistor Q1 is connected through a resistor R6 to a regulated voltage from the regulated power supply 30 and the emitter lead is grounded. The base lead is connected through an appropriate resistor R5 to the clock means 10. The collector of transistor Q1 is also directly connected to the base of transistor Q2 which is a Darlington amplifier connected in an emitter/follower configuration. The sensing resistor R1 is connected between the emitter of the Darlington amplifier Q2 and the glow plug 22. In the operation of the circuit under the control of the clock 10, the sensing resistor R1 is responsive to the current flowing through the glow plug 22. Since the Darlington amplifier Q2 is a constant voltage source, the voltage at the junction of the sensing resistor R1 and the glow plug 22 is a function of the resistance of the glow plug 22; hence, the temperature of the glow plug 22.

The temperature reference means 24 illustrated in FIG. 2 is a voltage divider means electrically connected in a bridge circuit with the glow plug 22 and sensing resistor R1. As illustrated, the voltage divider is a pair of resistors R12, R13 wherein the voltage signal at the junction of the resistors R12, R13 with reference to ground is proportional to the voltage across the glow plug 22 when the glow plug is at its operating temperature. The signal is connected to the inverting input 32 of an operational amplifier IC2 in the comparison means 16. Electrically connected through resistor R3 to the noninverting input 34 of the operational amplifier IC2 is the signal from the junction of the sensing resistor R1 and the glow plug 22. The output of the comparison means 16 is connected to a conventional latch means IC3 having as another input the clock means 10. The output of the latch means IC3 is connected to the logic means 28.

The logic means 28 comprises a pair of parallel transistors Q3 and Q4 which are configured in a wired configuration. Transistor Q3 responds to the clock signal and transistor Q4 responds to the signal from the latch means 18. The output of the logic means 28 is taken from the collectors of Q3 and Q4 which are directly connected to the base of a second Darlington amplifier Q5 in the power switch means 20. If the voltage at the collector of either transistor is low, then the base voltage of the second Darlington amplifier Q5 is low and the Darlington amplifier Q5 is off. However, if the voltage at both collectors is high, the transistors Q3 and Q4 being out of conduction, the base voltage of the second Darlington amplifier Q5 is high and it is turned on. Turning on the second Darlington amplifier Q5 turns on the power transistor Q6 allowing heavy current to be supplied to the glow plug 22.

FIG. 3A shows the current flow through the glow plug 22 during consecutive clock periods when the glow plug 22 is on. FIG. 3B shows the voltage across the glow plug 22 as supplied through the power transistor Q6. FIG. 3C illustrates a graph of the resistance characteristic of the glow plug 22. As indicated, the glow plug 22 has a positive temperature coefficient and as such as the temperature of the glow plug rises, its resistance also rises.

As illustrated in FIGS. 3A, 3B, and 3C there is a time period 36 when the resistance of the glow plug 22 is such that its temperature has reached a predetermined operating condition. In the present embodiment, this condition is 1000° C. The temperature reference means 24 output voltage signal represents the expected voltage across the glow plug 22 at 1000° C. This temperature is, of course, a matter of design. As shown in FIGS. 3A and 3B, when the output of the comparison means 16 indicates that the resistance of the glow plug 22 is at a value indicating a high temperature, the power transistor Q6 is not turned on and the voltage across the glow plug 22 is zero during the activation period of the clock. The time period 36 of FIGS. 3A and 3B illustrate that during the sampling period of the clock there is a small current through the glow plug 22 as well as a voltage across the glow plug 22.

While there has been discussed the application of the electronic controller to a positive temperature coefficient glow plug 22 as being the preferred embodiment, it is contemplated herein that this controller is applicable to any predetermined temperature coefficient heating device which transduces electrical power into heat. In such a device it requires a sensing means 12 for sensing the temperature of the heater and as a result of sensing the temperature, a temperature signal is generated representing that temperature. Depending upon the resistance value of the heating means and the desired level of heat to be generated, this signal may represent temperatures below 100° C. as well as temperatures well above 100° C. This temperature signal is then compared with a predetermined temperature signal for generating a comparison signal having an output signal indicating whether the heater is above, below or equal to the predetermined temperature value. The output of this comparison means is then supplied to a power driver circuit which controls the application of power; namely, electrical current to the heater.

All of the elements in the above controller are electronic in that there are no contacts or relays necessary. The advantage of using a positive temperature coefficient resistive material in the heating element is that as the device reaches its operating temperature, the peak power necessary to maintain the device at the operating temperature is reduced. The necessary power to operate the device is a function of the thermal mass of the device and its operating environment. If a negative temperature coefficient heater was used, then as the temperature of the heater increased, the resistance would decrease and the amount of current supplied to the device would increase.

Thus, the method for controlling the heating of a predetermined temperature coefficient heater comprises the steps of sensing the amount of current to the hearter or in the alternative the voltage across the heater. This voltage or current is then compared to a predetermined value of current or voltage which predetermined value represents the desired heating temperature. Then as a result of the comparing of the two values, the amount of power supplied to the heater is modified so as to bring the value of the operating temperature of the heater to the desired temperature.

Referring to FIG. 4, the above-described controller can be used in an overall system for controlling positive or negative temperature coefficient glow plugs 22 for starting diesel engines by locating at least one glow plug in each cylinder of the engine. A power switch 20 is provided for supplying power to each of the glow plugs 22 under the control of the controller, which is represented by the sensing means 16 and the power switch 20. One of the glow plugs 22 is sensed to generate a first electrical signal $V_1$ proportional to the temperature of the glow plug 22. An engine temperature sensor 38 is provided for determining the operating temperature of the engine and to generate a second electrical signal $V_2$ proportional to the actual operating temperature. A third electrical signal $V_3$ is generated from the glow plug temperature reference means 24 representing a predetermined operating temperature of the glow plug 22. A fourth electrical signal $V_4$ is generated from an engine temperature reference means 40 representing a predetermined operating temperature of the engine.

The first and third electrical signals $V_1$ and $V_3$ are then compared 48 and the resulting signal will be a representation of the relative temperatures of the glow plug 22 and the glow plug temperature reference means 24. If the resulting signal indicates that the actual temperature of the glow plug 22 is below the reference, this signal will be an actuating signal. In a similar manner the actual engine temperature signal $V_2$ and the engine temperature reference signal $V_4$ are compared 50 and the resulting signal will be an actuating signal when the engine is below the reference temperature. An actuating signal is a signal which, by itself, will enable the controller to supply power to the glow plug. The outputs from the comparators 48 and 50 are then coupled through a logic means 52 to the electronic controller for controlling the supplying of the power to the glow plugs 22.

Most systems may additionally include an ambient temperature sensor 44 to determine the environmental temperatures of the system. This sensor 44 generates an electrical signal $V_5$ which is supplied to a comparator 54 with another electrical signal $V_6$ from an ambient temperature reference means 46. The output of the comparison will be a signal which will be supplied to the logic means 52 indicating when the ambient temperature is high to block operation of the controller.

The time when the power is to be applied to the glow plugs may also be determined. Such a time is generally on engine start-up or during a cold start condition. The fuel being supplied to the cylinder is below the temperature that is necessary for the fuel to be ignited in the cylinder.

Depending upon the configuration, there may be one controller per glow plug 22 or several glow plugs may operate from one controller as illustrated in FIG. 4. There the current is measured to the one glow plug that is selected to the measured glow plug. As a result of this measurement, the time base signal is generated for controlling the application of power to the remaining glow plugs. As previously illustrated, this time base signal may have a characteristic of either being on or off for one unit of time or such signal may be used to maintain current to the glow plug until such time as the glow plug reaches tempeature.

There are other conditions which a system may respond to for controlling the operation of the glow plug.

One such condition may be a constraint as to the maximum time that the glow plug may be energized. Thus the controller may be used in an overall system wherein several conditions are sensed. These conditions will be electrically coupled to the controller for controlling, as an end result, the application of power to the glow plugs. As stated previously, time sharing, multiplexing and large capacity electronic components may be used to permit one controller to control all of the glow plugs in an engine.

What is claimed is:

1. In a diesel engine a system for controlling positive temperature coefficient glow plugs comprising:

at least one positive temperature coefficient glow plug in each cylinder of a diesel engine;

clock means for generating clock signals having a sample period and an activation period;

contactless means for applying activating current to each of said glow plugs;

means for sensing an amount of sensing current to only one of said glow plugs during said sample period of said clock means and generating a first electrical signal proportional to the amount of sensed current, said sensing current being less than said activating current and said sensing means not responsive to said activating current to said glow plugs;

means for generating a second electrical signal proportional to the actual temperature of the diesel engine;

means for generating a third electrical signal representing a predetermined glow plug temperature;

means for generating a fourth electrical signal representing a predetermined operating temperature of said engine;

means responsive to said first and third electrical signals during said activation period of said clock means for activating said contactless means for applying activating current to each of said glow plugs when said actual temperature is less than said predetermined operating temperature; and means responsive to said second and fourth electrical signals for inhibiting said contactless means for applying activating current to each of said glow plugs when said temperature of said engine is equal to said predetermined operating temperature.

2. A contactless electronic controller for heating a single glow plug comprising:

a glow plug;

clock means for generating clock signals having a sample period and an activation period;

a constant voltage means activated by said sample period of said clock means;

a sensing resistor electrically connected in series between said constant voltage means and said glow plug, said resistor responsive to the voltage drop across said glow plug due to a sensing current flowing therethrough for generating a voltage signal representing the temperature of said glow plug;

means for generating a voltage signal representing the desired operating temperature of said glow plug;

comparison means responsive to said voltage signals representing the desired operating temperature and said temperature of said glow plug for generating a comparison signal when the temperature of said glow plug is less than the desired operating temperature;

latch circuit means responsive to said activation period and said comparison signal for generating a power applying control signal; and contactless power driver circuit means electrically connected series with said glow plug and in electrical parallel with said constant voltage means and said sensing resistor and responsive to said power applying signal for supplying activating current to said glow plug for raising its temperature to the desired operating temperature.

* * * * *